US007363733B2

(12) United States Patent
Stoetzer

(10) Patent No.: US 7,363,733 B2
(45) Date of Patent: Apr. 29, 2008

(54) DEVICE AND METHOD FOR MAKING A TRENCH WALL IN THE SOIL

(75) Inventor: Erwin Emil Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 293 days.

(21) Appl. No.: 11/189,848

(22) Filed: Jul. 27, 2005

(65) Prior Publication Data

US 2006/0037218 A1 Feb. 23, 2006

(30) Foreign Application Priority Data

Aug. 23, 2004 (EP) ..... 04019987

(51) Int. Cl.
*E02F 3/24* (2006.01)

(52) U.S. Cl. ..... 37/189; 37/91; 37/462; 175/96; 299/75

(58) Field of Classification Search ..... 37/91, 37/189, 352, 468, 462; 299/106, 75; 175/96, 175/91

See application file for complete search history.

(56) References Cited

U.S. PATENT DOCUMENTS

| | | | | |
|---|---|---|---|---|
| 2,950,902 | A * | 6/1960 | Olds | 175/91 |
| 3,710,878 | A * | 1/1973 | Endo et al. | 175/66 |
| 3,894,587 | A | 7/1975 | Sourice | |
| 4,629,010 | A * | 12/1986 | Sourice | 175/57 |
| 4,682,660 | A * | 7/1987 | Barthelemy et al. | 175/96 |
| 4,694,915 | A | 9/1987 | Bauer et al. | |
| 4,718,504 | A * | 1/1988 | Terashima et al. | 175/96 |
| 4,744,425 | A * | 5/1988 | Hentschel | 175/73 |
| 4,785,559 | A * | 11/1988 | Hentschel | 37/94 |
| 4,800,967 | A * | 1/1989 | Chagnot et al. | 175/96 |
| 4,883,134 | A * | 11/1989 | Bollinger et al. | 175/96 |
| 4,930,940 | A * | 6/1990 | Charlier et al. | 405/267 |
| 5,035,071 | A * | 7/1991 | Stotzer et al. | 37/94 |
| 5,111,601 | A * | 5/1992 | Casagrande | 37/91 |
| 5,964,305 | A * | 10/1999 | Arzberger et al. | 175/91 |
| 6,193,444 | B1 * | 2/2001 | Jonninen | 405/258.1 |
| 6,626,500 | B1 * | 9/2003 | Cribb et al. | 299/78 |
| 7,114,271 | B2 * | 10/2006 | Chagnot et al. | 37/352 |
| 7,152,346 | B2 * | 12/2006 | Arzberger | 37/189 |
| 7,178,273 | B2 * | 2/2007 | Arzberger | 37/189 |
| 2004/0234345 | A1 | 11/2004 | Arzberger | |
| 2005/0229440 | A1 * | 10/2005 | Arzberger | 37/352 |
| 2006/0032671 | A1 * | 2/2006 | Arzberger | 175/57 |

FOREIGN PATENT DOCUMENTS

| | | | |
|---|---|---|---|
| DE | 4008207 | A1 | 8/1990 |
| DE | 4141629 | C2 | 6/1993 |
| DE | 19530827 | C2 | 2/1997 |
| EP | 0446712 | A1 | 9/1991 |
| EP | 0811724 | A1 | 12/1997 |
| JP | 07054334 | A | 2/1995 |
| JP | 07056361 | A | 3/1995 |

* cited by examiner

*Primary Examiner*—Thomas A Beach
(74) *Attorney, Agent, or Firm*—Jacobson Holman PLLC

(57) ABSTRACT

The invention relates to a device for making a trench wall in the soil comprising a frame, at least one lower cutting/mixing wheel arranged at the bottom of the frame, at least one further, upper cutting/mixing wheel arranged at the top of the frame, wherein the frame is designed in an intermediate portion between the upper cutting/mixing wheel and the lower cutting/mixing wheel with a smaller cross section with respect to the cutting cross section of the at least one lower cutting/mixing wheel. The invention further relates to a method for making a trench in the soil by means of such a device.

17 Claims, 3 Drawing Sheets

DEVICE AND METHOD FOR MAKING A TRENCH WALL IN THE SOIL

The invention relates to a device for making a trench wall in the soil. The invention further relates to a method for making a trench wall in the soil.

A method for making a trench wall in the soil is known from DE 195 30 827 C2. In this so-called two-phase method a cut trench is excavated in a first phase and the spoil resulting from the cut trench is conveyed above ground. The cut trench thus produced is filled with a support suspension whereby it is supported. In a second phase following the sinking of the cut trench a hardening suspension is introduced into the trench whilst displacing the support suspension.

In a one-phase method known from DE 41 41 629 C2 the trench is supported from the outset by a hardening suspension produced above ground by mixing excavated soil material with a settable liquid.

In order to carry out these known methods use can be made of the trench wall cutters known from DE 34 24 999 C2. These known trench wall cutters have a cutting frame and rotatably drivable cutting wheels that are supported at the bottom of the frame, i.e. facing towards the ground, and serve to strip soil material from the bottom of the trench. The stripped soil material is conveyed by the cutting wheels to a suction device mounted on the cutting frame and transported above ground.

From the German patent application bearing the reference number 103 08 538 a further method for making a trench wall is known. In this so-called "mixed-in-place"-method the hardening suspension is not produced outside the trench but directly inside the trench itself. To this end soil material stripped by the cutting wheels is mixed quasi "in situ" with the settable liquid in the cut trench as a result of the action of the cutting wheels so that a hardening liquid-soil mixture is produced. In this method the stripped soil material which is intermixed with the settable liquid is at least partly left in the cut trench where it can harden to form the trench wall. As a result, there is no longer any need for the entire stripped soil material to be conveyed above ground in a complicated manner by employing pumping devices.

The object of the invention is to provide a device and a method with which trench walls of a particularly high quality can be made.

This object is solved according to the invention by a device having the features of claim 1 and by a method having the features of claim 12. Preferred embodiments are stated in the respective dependent claims.

The invention resides on the one hand in a device for making a trench wall in the soil comprising a frame, at least one lower cutting/mixing wheel arranged at the bottom of the frame, at least one further, upper cutting/mixing wheel arranged at the top of the frame, wherein the frame is designed in an intermediate portion between the upper cutting/mixing wheel and the lower cutting/mixing wheel with a smaller cross section with respect to the cutting cross section of the at least one lower cutting/mixing wheel.

A first basic idea of the invention may be seen in the fact that cutting/mixing wheels are provided both at the bottom of the cutting frame, i.e. facing towards the ground, and at the top of the cutting frame. The at least one lower cutting/mixing wheel preferably protrudes from the frame in the advance direction while the at least one upper cutting/mixing wheel protrudes in a direction opposed to the advance direction. Owing to the arrangement of cutting/mixing wheels on both sides of the frame, a particularly good break-up and intermixing of stripped soil material is rendered possible. In particular, when producing an "in situ" suspension in the trench with the device according to the invention, it is possible to achieve an especially high homogeneity of the suspension and thus a particularly high trench wall quality. Furthermore, as a result of a combined cutting effect of the upper and lower cutting/mixing wheels a particularly high cutting progress can be attained.

A further basic idea of the invention may be seen in the fact that at least in some portions the frame is designed with a cross section that is smaller than the cutting cross section of the at least one lower cutting/mixing wheel. In this way, a mixing and conveying portion is created in the trench between the upper and the lower cutting/mixing wheels which allows for an exchange of material between the upper and the lower cutting/mixing wheels. Since a flow can be created in this mixing and conveying portion both by the upper and the lower cutting/mixing wheel, an especially effective mixing of the materials take place in this portion as a result of which the homogeneity of the suspension is increased further. For a particularly good exchange of materials the frame is additionally designed in the intermediate portion with a smaller cross section with respect to the cutting cross section of the at least one upper cutting/mixing wheel.

The device according to the invention may also be referred to as cutter, in particular as trench wall cutter. The cutting/mixing wheels can have circumferential cutting teeth, roller bits or other earth working tools for stripping outcropping soil material. However, at least part of the cutting/mixing wheels can in principle also be designed without such earth working tools, in which case the mixing effect of these wheels is then in the foreground. To further improve the mixing effect at least part of the cutting/mixing wheels can be provided with additional mixing elements such as mixing paddles. Basically, it is possible that the at least one lower cutting/mixing wheel and the at least one upper cutting/mixing wheel have the same constructional design, and for a counter-rotating operation the wheels may also be designed mirror-symmetrically with respect to each other. However, it is particularly preferred that only the lower cutting/mixing wheel has circumferential earth working tools and/or that the at least one upper cutting/mixing wheel has additional mixing elements.

Basically, the intermediate portion of the frame with the smaller cross section may be constituted by a step in the frame for example. However, it is particularly preferred that the frame between the upper cutting/mixing wheel and the lower cutting/mixing wheel is designed in a waisted manner. More particularly, it can be understood by this that in at least one spatial direction the cross section of the frame continuously tapers in the advance direction, when starting from the upper cutting/mixing wheel, and that it continuously widens again before the lower cutting/mixing wheel. A cross section within the meaning of the invention can in particular be understood as a section perpendicular to the advance direction of the cutter.

It is suitable for the cutting cross section of the at least one lower cutting/mixing wheel to have an at least approximately rectangular design. It is particularly preferred, however, that the cross sectional width of the frame amounts in the intermediate portion to three fourths or less, in particular half or less of the cutting cross sectional width of the at least one lower cutting/mixing wheel and/or that the cross sectional length of the frame amounts in the intermediate portion to three fourths or less, in particular half or less of the cutting cross sectional length of the at least one lower cutting/mixing wheel. Through this, a mixing and conveying portion is created around the intermediate portion in which a particularly effective intermixing of the suspension can take place. The indications of length and width may especially relate to an at least approximately rectangular cutting cross section, whereas the frame itself, in particular in the intermediate portion, does not necessarily have to be designed with a rectangular cross section. In case of a non-rectangular frame the cross sectional width and length may be understood as the cross sectional dimensions of the frame parallel to the sides of the approximately rectangular cutting cross section. If several lower cutting/mixing wheels are provided, the cutting cross section of the at least one lower cutting/mixing wheel may be understood as the overall cutting cross section of all the wheels. By analogy, the cutting cross section of the at least one upper cutting/mixing wheel may be understood as the overall cutting cross section of all upper cutting/mixing wheels. Advantageously, the cutting cross section of the at least one upper cutting/mixing wheel also has an at least approximately rectangular design and is in particular at least approximately identical to the cutting cross section of the at least one lower cutting/mixing wheel.

A device that is particularly suited to absorb the forces occurring during the cutting operation and has an especially simple construction is characterized in that the frame and/or the cutting/mixing wheels are designed mirror symmetrically, particularly with respect to a mirror plane extending perpendicularly to the advance direction and/or to a mirror plane extending in the advance direction. The advance direction can be understood as the direction in which the inventive cutter moves when producing the trench, i.e. the direction in which the cutter is sunk.

Another preferred embodiment of the invention resides in the fact that two lower cutting/mixing wheels and two upper cutting/mixing wheels are provided in particular paraxially and that the frame is designed in particular in an X-shaped manner having a frame centre part and four cutting shields arranged thereon preferably in an oblique manner to the advance direction, on which the cutting/mixing wheels are supported. According to this embodiment the frame is designed in a cross-shaped fashion, with at least one cutting/mixing wheel, in particular a wheel pair each, being supported at the end on the four legs of the cross, respectively. The legs of the cross are preferably constituted by the cutting shields.

Furthermore, it is especially advantageous for the cutting/mixing wheels to be designed as wheel pairs with two single wheels which are each arranged in particular coaxially on both sides of a cutting shield of the frame. The individual cutting/mixing wheels can also include more than two single wheels. In principle, any number of cutting/mixing wheels can be provided in accordance with the invention.

The device according to the invention is particularly suited for a "mixed-in-place" trench wall cutting method, in which the suspension that hardens to constitute the trench wall is not produced outside the cut trench but directly inside the cut trench itself from stripped soil material and a settable liquid as a result of the action of the cutting/mixing wheels. In this connection it is particularly advantageous for a liquid supply device to be provided at the bottom of the frame, in particular between two adjacent lower cutting/mixing wheels, in order to supply a settable liquid into the trench. By arranging the liquid supply device between the two cutting/mixing wheels a particularly homogeneous intermixing of the liquid with the soil material is rendered possible at both cutting/mixing wheels. In principle, the liquid supply device can also be designed separately from the frame and/or the cutter.

Another advantageous aspect of the invention resides in the fact that cutting teeth are provided at least on the lower cutting/mixing wheel in order to strip off outcropping soil material and that scraper plates are provided on the frame which project between adjacent cutting teeth so as to free the cutting teeth from stripped soil material. During the operation of the cutting/mixing wheels the cutting teeth are moved past the scraper plates, whereby soil adhering to the cutting teeth is stripped off by the scraper plates. This allows a particularly good cutting progress. In particular, the scraper plates may serve to clean cutting teeth designed as hinged teeth that are pivotally arranged below the cutting shield on the cutting/mixing wheels in order to strip off soil material.

For a directional control of the device during the sinking it can be intended according to the invention that preferably hydraulically operable control props are provided on the frame, which can be extended transversely to the advance direction, in particular approximately parallel to the rotational axes of the cutting/mixing wheels, in order to abut against the inner walls of the trench. By extending these control props towards the inner walls of the trench the frame can be kept away from the walls and its position, in particular its inclination in the trench, can be changed and as a consequence of which the further sinking direction is changed, too. By preference, the control props have round, in particular approximately circular or oval-shaped supporting surfaces that can also have a convex design. In particular, the control props can be designed in a mushroom-shaped manner. The control props are suitably arranged on prop holders which are in turn arranged on the frame whilst protruding in particular laterally therefrom. On these prop holders drives can be provided, in particular hydraulic cylinders, for extending and retracting the control props. Basically, the control props can be extended on the frame in any chosen direction but it is preferred that the control props can be extended approximately parallel to the rotational axes of the cutting/mixing wheels. The control props are preferably arranged on the frame centre part in the intermediate portion.

Advantageously, on each control prop holder two control props are provided that constitute a pair of control props. It is of advantage for the two control props of a pair of control props to be arranged coaxially and/or to be extendable from the frame on opposite sides of the frame. It is particularly preferred that two pairs of control props are each arranged on top of each other on both sides of the frame. Advantageously, two pairs of control props are each positioned at the same height on the frame.

For the lowering and drawing of the device it is preferred that a rope and/or a telescopic drill rod is provided on which the frame is suspended by its upper side. The telescopic drill rod can be designed as a Kelly bar in particular. As an advantage, a retaining bar is provided on the rope or drill rod, on which the frame is hooked in.

In accordance with the invention a particularly versatile device is characterized in that the cutting cross section of the at least one upper cutting/mixing wheel and/or of the at least one lower cutting/mixing wheel can be changed. For this purpose for example an adjusting device can be provided, through which the distance between the axes of the upper cutting/mixing wheels and/or the lower cutting/mixing wheels can be adjusted. Alternatively or additionally the cutting radius of the respective cutting/mixing wheels can also be changed by means of the adjusting device.

If several, more particularly two lower cutting/mixing wheels are provided they are suitably arranged next to each other, i.e. their rotational axes lie at the same height, especially with respect to the downward facing advance direction. Likewise, if several upper cutting/mixing wheels are provided, these are also arranged preferably next to each other.

A further aspect of the invention can be considered as residing in a method for making a trench wall in the soil, in which a trench wall cutter is provided having a frame, two lower cutting/mixing wheels arranged next to each other at the bottom of the frame and two upper cutting/mixing wheels arranged next to each other at the top of the frame, in which the cutting/mixing wheels are set into rotation by means of a rotary drive and the trench wall cutter is sunk into the soil and retracted upon reaching a final depth, wherein both the two upper cutting/mixing wheels and the two lower cutting/mixing wheels are each driven in opposite directions by the rotary drive.

The method according to the invention can be carried out in particular by means of the device according to the invention, in which case the advantages described in connection herewith can be achieved.

A basic idea of the inventive method can be seen in the fact that a trench wall cutter is provided having at least two lower cutting/mixing wheels and at least two upper cutting/mixing wheels, in which the two lower cutting/mixing wheels are driven in a counter-rotating manner and the two upper cutting/mixing wheels are equally driven in a counter-rotating manner. Owing to this counter-rotating operation of both the upper and lower cutting/mixing wheels a deviation of the trench wall cutter can be prevented to a large extent so that cut trenches can be produced that are particularly well-defined from a geometric point of view. At the same time a particularly efficient removal of the soil material stripped at the bottom of the trench is rendered possible. Finally, in order to produce a hardening suspension a particularly good intermixing of the stripped soil material with a settable liquid can also take place, especially if the settable liquid is supplied into the trench from the centre between the two lower cutting/mixing wheels and/or between the two upper cutting/mixing wheels. According to the invention the counter-rotating operation of the cutting/mixing wheels can generally be provided both during the sinking and retraction of the trench wall cutter. But the cutting/mixing wheels can also be inoperative during the retraction of the trench wall cutter. However, for a particularly good intermixing of the suspension it is of advantage that the cutting/mixing wheels are rotatably driven also during the retraction, in which case the rotational direction of the cutting/mixing wheels can generally be changed in an alternating manner.

The efficiency of the material removal in the cut trench can be improved in that during the sinking of the trench wall cutter soil material stripped at the bottom of the trench is removed from the centre of the cutter through the rotation of the lower cutting/mixing wheels. This embodiment proves to be of particular advantage if the stripped soil material is not sucked off from the cut trench but remains in the cut trench for an "in situ"-mixing with a settable liquid. According to this embodiment, during the sinking the lower cutting/mixing wheel arranged on the left side in the operating condition of the cutter as seen in front view is operated in the clockwise direction and the lower cutting/mixing wheel arranged next to the former on the right side in the operating condition of the cutter is operated in the counter-clockwise direction. By preference, the stripped soil material is conveyed to the mixing and conveying portion formed around the frame in its intermediate portion. As a result, a particularly efficient intermixing of the soil material with the settable liquid is ensured. At the same time the tangential movement of the lower cutting/mixing wheels on the inner walls of the cut trench promotes the sinking movement of the trench cutter in the advance direction.

In principle, it is possible to operate the upper cutting/mixing wheels as opposed to the cutting/mixing wheels lying below in any chosen sense of rotation. For instance it can be intended that the cutting/mixing wheels lying on top of each other on the frame are each rotated in opposite directions, i.e. that the two cutting/mixing wheels arranged on the left side of the frame are rotated at opposed senses of rotation just as the two cutting/mixing wheels located on the right side of the frame. However, it is particularly preferred that cutting/mixing wheels lying on top of each other on the frame are driven in the same direction. In this case a particularly good removal of material is ensured.

In general, it is furthermore possible to choose the sense of rotation of the cutting/mixing wheels during the retraction of the trench wall cutter to be the same as the sense of rotation during the sinking. However, it is particularly preferred that the sense of rotation at least of the lower cutting/mixing wheels is reversed for the retraction of the trench wall cutter. It is useful for the sense of rotation of the upper cutting/mixing wheels to be also reversed for the retraction of the trench wall cutter. The change of the flow profile on the trench wall cutter resulting therefrom allows a further improvement of the intermixing of the suspension.

With regard to the sense of rotation of the cutting/mixing wheels it is of advantage that, on account of their rotating movement on the inner walls of the trench, the cutting/mixing wheels carry out a tangential movement that is opposed to the respectively actual axial movement of the trench wall cutter. In this manner the rotating movement of the cutting/mixing wheels promotes the axial sinking and retracting movement of the trench wall cutter so that axial driving devices used for the sinking and retracting of the trench wall cutter can thus be dimensioned in a less complicated way.

In the following the invention will be described in greater detail by way of preferred embodiments illustrated in the figures. In the figures the following schematic illustrations are shown:

Elements having the same function are designated with the same reference signs in all figures.

Figure 1:
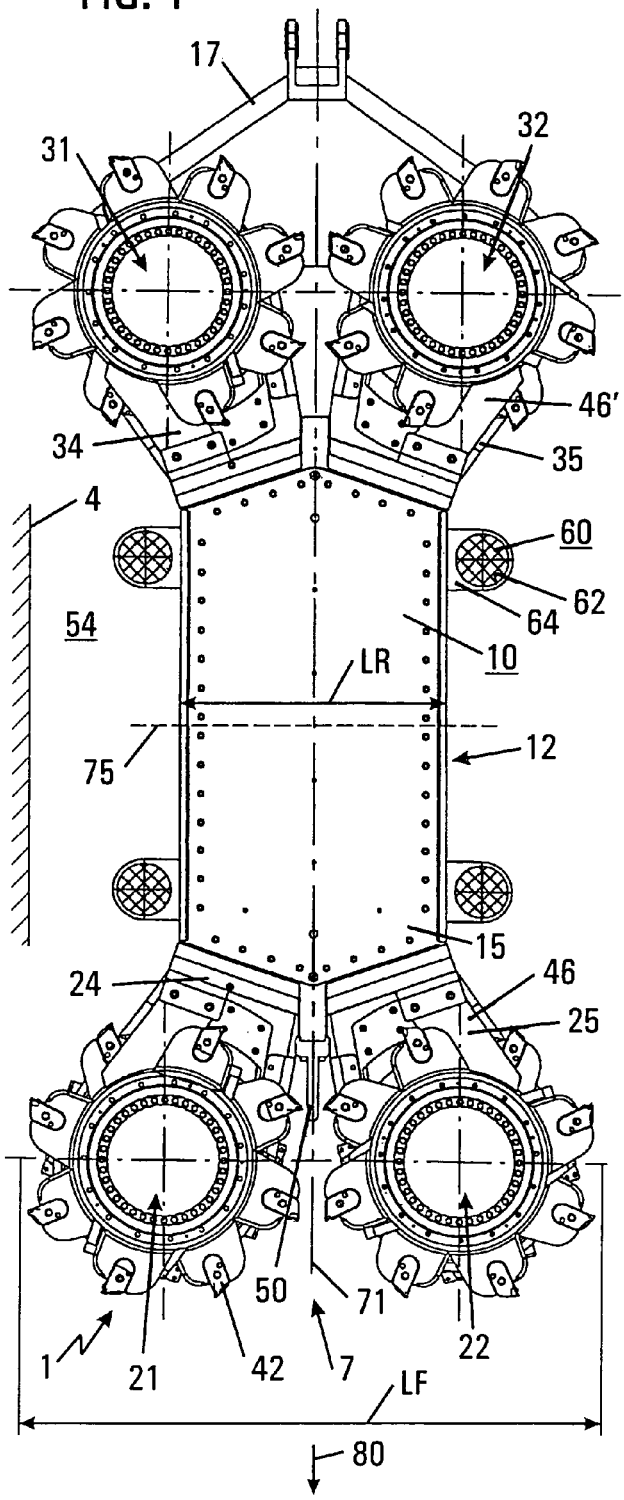
FIG. 1 shows a front view of a device according to the invention for making a trench in the soil.
Figure 2:
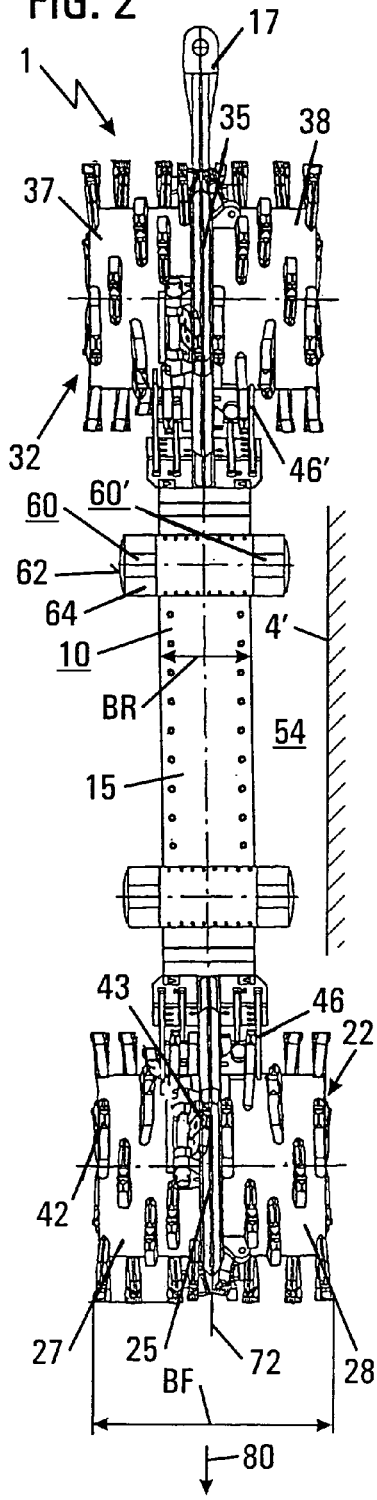
FIG. 2 shows a side view of the device of FIG. 1.

A device according to the invention for making a trench wall in the soil, which may also be referred to as trench wall cutter 1, is depicted in FIGS. 1 and 2. The trench wall cutter 1 has a supporting frame 10 at whose lower end, i.e. facing towards the ground, two lower cutting/mixing wheels 21, 22 are rotatably supported at the same height. At the upper side of the frame 10 two upper cutting/mixing wheels 31, 32 are likewise rotatably supported at the same height.

The cutting/mixing wheels 21, 22, 31, 32 are all designed as wheel pairs having each two single wheels that are both supported coaxially on both sides of a respective cutting shield 24, 25, 34, 35. In FIG. 2 this is illustrated on the example of the upper cutting/mixing wheel 32 whose two single wheels 37, 38 are arranged on both sides of the cutting shield 35. Moreover, this is illustrated in FIG. 2 on the example of the lower cutting/mixing wheel 22 whose two single wheels 27, 28 are rotatably supported on both sides of the cutting shield 25. The remaining cutting/mixing wheels 21, 31 are analogously designed as wheel pairs.

In its centre the frame 10 has a frame centre part 15. This frame centre part 15 is designed in the shape of a right prism having a hexagonal base. At both of its upper adjacent lateral surfaces the two cutting shields 34, 35 of the upper cutting/mixing wheels 31, 32 protrude from the frame centre part 15. At both of its lower adjacent lateral surfaces the two cutting shields 24, 25 of the two lower cutting/mixing wheels 21, 22 protrude from the frame centre part 15. The cutting shields 24, 25, 34, 35, which can be regarded as elements of the frame 10, extend at an angle, i.e. not in parallel to the advance direction 80 that stands for the sinking direction of the trench wall cutter 1. Together with the frame centre part 15 the cutting shields 24, 25, 34, 35 form a cross-shaped or X-shaped structure, in which the legs of the cross are constituted by the cutting shields 24, 25, 34, 35. In this the legs of the cross formed by the cutting shields 24, 25, 34, 35 are not arranged perpendicularly to each other. On the contrary, just as the angle enclosed by the cutting shields 34, 35, the angle enclosed by the cutting shields 24, 25 is smaller than 90°.

At the circumference of the cutting/mixing wheels 21, 22, 31, 32 fixed cutting teeth 42 are arranged that include a cutting edge to strip off outcropping soil material. Adjacent to their respective cutting shield 24, 25, 34, 35 cutting teeth designed as hinged teeth 43 are additionally provided on the cutting/mixing wheels 21, 22, 31, 32. Through a pivot drive these hinged teeth 43 can be pivoted into a circumferential portion of the respective cutting shield 24, 25, 34, 35. With these hinged teeth 43 in particular soil material located below the cutting shields 24, 25 can be dislodged.

By operating the lower cutting/mixing wheels 21, 22 soil material located below the trench wall cutter 1 is stripped in a cutting cross section of approximately rectangular shape. This cutting cross section has a cutting cross sectional width BF and a cutting cross sectional length LF, with the width being related here to the direction of the axes of rotation of the lower cutting/mixing wheels 21, 22. The axes of rotation of the lower cutting/mixing wheels 21, 22 as well as the axes of rotation of the upper cutting/mixing wheels 31, 32 are arranged parallel to each other. The distance of the axes of rotation of the two lower cutting/mixing wheels 21, 22 corresponds to the distance of the axes of rotation of the two upper cutting/mixing wheels 31, 32. In relation to the downward facing advance direction 80 the upper cutting/mixing wheel 31 is arranged above the lower cutting/mixing wheel 21 and the upper cutting/mixing wheel 32 is arranged above the lower cutting/mixing wheel 22. Here all cutting/mixing wheels 21, 22, 31, 32 have the same wheel diameter. On account of this geometric arrangement and design of the cutting/mixing wheels 21, 22, 31, 32 the cutting cross section of the upper cutting/mixing wheels 31, 32 corresponds to the cutting cross section of the lower cutting/mixing wheels 21, 22.

In an intermediate portion 12 provided on the frame centre part 15 the frame 10 is designed with a tapering where it has a smaller cross section with respect to the cutting cross section of both the lower cutting/mixing wheels 21, 22 and the upper cutting/mixing wheels 31, 32. In this way a mixing and/or conveying portion 54 is formed on the intermediate portion 12 between the inner walls 4, 4' of the trench, depicted only partly here, and the frame 10, in which a mixing of stripped soil material with a settable liquid can take place. For the supply of the settable liquid into the cut trench a liquid supply device 50 designed as a nozzle is provided in the cutter centre 7 between the two lower cutting/mixing wheels 21, 22.

As can be seen in FIG. 1, in order to form the tapered intermediate portion 12 the frame 10 is designed in a waisted manner in its cross sectional length LR when starting from the cutting shields 24, 25, 34, 35. However, as can be taken from FIG. 2, the cross sectional width BR of the frame 10 remains substantially constant across its height. In the intermediate portion 12 on the frame centre part 15 the cross sectional width BR of the frame 10 is approximately the 0.45-fold amount of the cutting cross sectional width BF and the cross sectional length LR of the frame 10 is approximately the 0.45-fold amount of the cutting cross sectional length LF.

The frame 10 with its cutting shields 24, 25, 34, 35 and the cutting/mixing wheels 21, 22, 31, 32 is designed in a triple mirror symmetrical fashion, in which a first mirror plane 75 is arranged perpendicularly to the advance direction 80 and two further mirror planes 71, 72 arranged perpendicularly to each other extend in parallel to the advance direction 80.

On the cutting shields 24, 25, 34, 35 scraper plates 46, 46' are provided that project between adjacent cutting teeth 42 and/or hinged teeth 43. To this end the scraper plates 46, 46' are arranged approximately radially to the cutting/mixing wheels 21, 22, 31, 32. On rotation of the cutting/mixing wheels 21, 22, 31, 32 the cutting teeth 42 and/or the hinged teeth 43 move past the scraper plates 46, 46' whereby soil material adhering to the cutting teeth 42 and/or hinged teeth 43 is scraped off and the teeth are freed from the soil. To drive the cutting/mixing wheels 21, 22, 31, 32 hydraulic drive motors not depicted in the figures are provided in the inside of the frame centre part 15 of the frame 10.

Control props 60, 60' are provided laterally on the frame centre part 15 of the frame 10, which can be extended approximately parallel to the axes of rotation of the cutting/mixing wheels 21, 22, 31, 32 and perpendicularly to the advance direction 80 into an abutting position on the inner walls 4' of the trench and which can be retracted again so as to control the direction of the trench wall cutter 1. The control props 60, 60' are mushroom-shaped and have at their top convex curved supporting surfaces 62 that are circular in front view so as to abut against the inner walls 4' of the trench.

As can be gathered from FIG. 2, the control props 60, 60' are arranged coaxially in pairs on both sides of the frame 10, with one of the two control props 60 of each pair of control props being disposed in the front of the frame 10 and the other control prop 60' being disposed at the back of the frame 10, as depicted in the front view of FIG. 1. As can furthermore be taken from FIG. 1, in total four pairs of control props are provided on the frame 10, of which two pairs each are mounted on the left and right side on the frame centre part 15 at the same height in relation to the downward facing advance direction 80 when seen from a frontal view. The two control props 60, 60' of each pair of control props are supported in a joint prop holder 64 which surrounds the control props 60, 60' in a sleeve-like manner. In the prop holder 64 drives for extending and retracting the control props 60, 60', which are not illustrated in the figures, are provided, too.

For the suspension of the trench wall cutter 1 on a rope or a Kelly bar, not shown in FIGS. 1 and 2, a retaining bar 17 is provided which is supported at the top of the trench wall cutter 1 on the cutting shields 24, 25.

Figure 3:
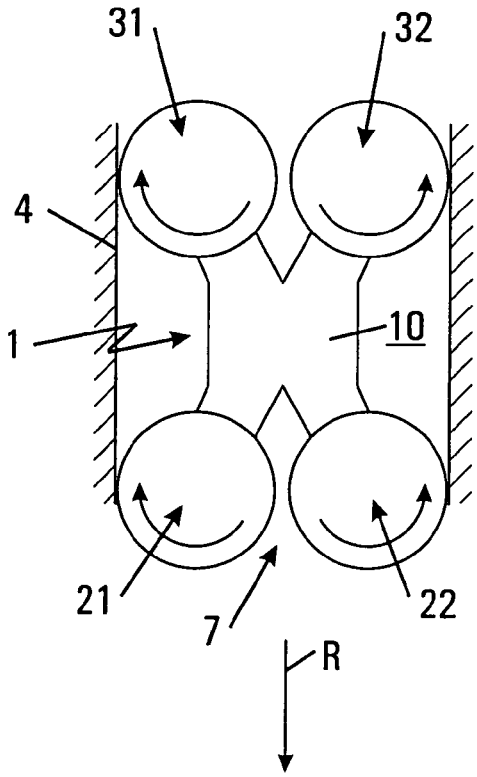
FIG. 3 shows a front view of a further cutter according to the invention to illustrate the sense of rotation of the cutting/mixing wheels during the sinking of the cutter.
Figure 4:
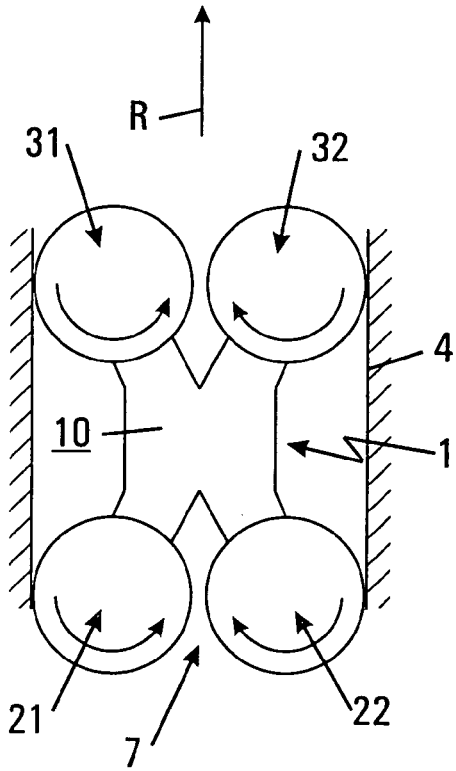
FIG. 4 shows a front view of the cutter of FIG. 3 to illustrate the sense of rotation of the cutting/mixing wheels during the retraction of the cutter.

In FIGS. 3 and 4 the sense of rotation of the cutting/mixing wheels 21, 22, 31, 32 of a trench wall cutter 1 according to the invention is shown during the implementation of a method according to the invention. FIG. 3 shows the condition present during the sinking and FIG. 4 shows the condition present during the retraction of the trench wall cutter 1. The corresponding axial movement of the trench wall cutter 1 is illustrated by the arrows R.

As can be taken from FIG. 3, the lower cutting/mixing wheels 21, 22 are rotated in such a manner during the sinking of the cutter that stripped soil material and settable liquid introduced into the cut trench is conveyed from the cutter centre 7 to the inner walls 4 of the cut trench. For this purpose the cutting/mixing wheel 21 arranged on the left side is rotated in the clockwise direction and the cutting/mixing wheel 22 arranged on the right side is rotated in the counter-clockwise direction. The upper cutting/mixing wheels 31, 32 arranged above the lower cutting/mixing wheels 21, 22 are operated in the same sense of rotation as the respective cutting/mixing wheels 21, 22 lying below, i.e. the upper cutting/mixing wheel 31 arranged on the left side is rotated in the clockwise direction and the upper cutting/mixing wheel 32 arranged on the right side is rotated in the counter-clockwise direction.

During the retracting operation of the trench wall cutter 1 illustrated in FIG. 4 the sense of rotation of all cutting/mixing wheels 21, 22, 31, 32 is reversed.

The sense of rotation of the cutting/mixing wheels 21, 22, 31, 32 is chosen such that at their point of contact with the inner walls 4' of the trench the wheels, on account of their rotary movement, move in a manner tangentially opposed to the axial movement R of the cutter.

Figure 5:
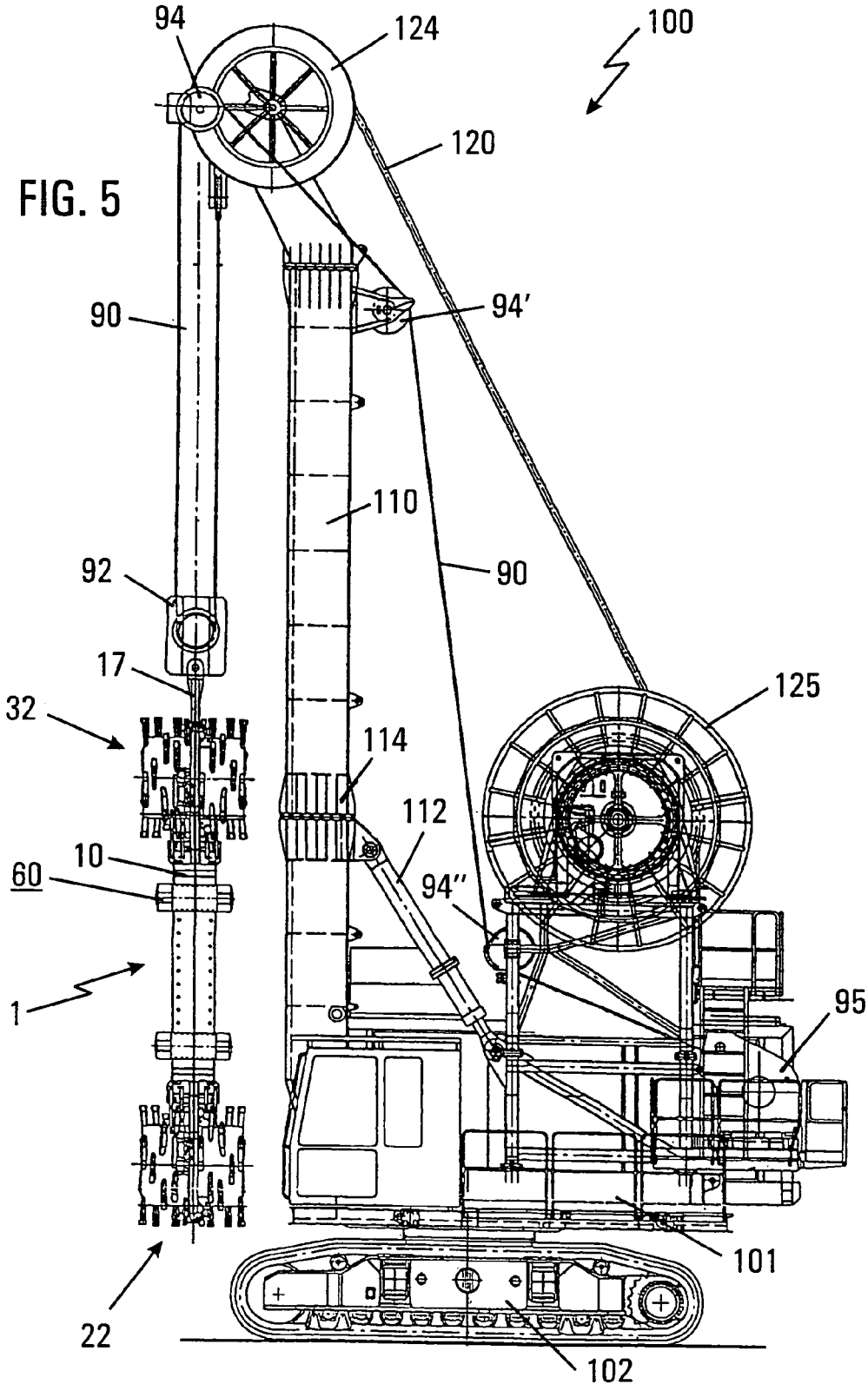
FIG. 5 shows a side view of a constructional apparatus including a device according to the invention.

FIG. 5 shows a constructional apparatus 100 on which a trench wall cutter 1 in accordance with the invention is disposed. The constructional apparatus includes a lower carrier implement 102 designed as a crawler gear and an upper carrier implement 101 that is arranged rotatably on the former. On the upper carrier implement 101 a mast 110 is pivotally hinged about a horizontally extending axis. To pivot the mast 110 a hydraulic operating cylinder 112 is provided which is hinged on one side to the upper carrier implement 101 and on the other side to a sleeve 114 which encloses the mast 110 at least in sections.

For the suspension of the trench wall cutter 1 a rope 90 is provided which can be operated by a winch 95 located on the upper carrier implement 101. The rope 90 emerging from the winch 95 is guided around the mast 110 via several guide pulleys 94, 94', 94". From the uppermost guide pulley 94 the rope runs to a pulley case 92, on which the trench wall cutter 1 is hooked in. The rope 90 is reeved in a double-stranded manner into the pulley case 92.

In addition to the rope 90 hydraulic and fluid lines 120 are also provided on the constructional apparatus to supply the trench wall cutter 1 with hydraulic fluid and settable liquid. These hydraulic and fluid lines 120 can be wound up by means of a winch device 125 arranged on the upper carrier implement 101. From this point they extend via a guide pulley 124 that is equally arranged on the mast 110 to the trench wall cutter 1.

The invention claimed is:

1. Device for making a trench wall in the soil, the device having a sinking direction, the device comprising:

a frame having an advance direction same as the sinking direction, at least two lower cutting/mixing wheels arranged at the bottom of the frame, at least two further, upper cutting/mixing wheels arranged at the top of the frame, wherein the frame is designed in an intermediate portion between the upper cutting/mixing wheels and the lower cutting/mixing wheels with a smaller cross section with respect to the cutting cross section of the at least two lower cutting/mixing wheels, and wherein the frame is configured in an X-shaped manner having a frame centre part and four cutting shields arranged thereon obliquely to the advance direction, on which the cutting/mixing wheels are supported.

2. Device according to claim 1, wherein the frame located between the upper cutting/mixing wheels and the lower cutting/mixing wheels is designed in a waisted manner.

3. Device according to of claim 1, wherein in the intermediate portion, at least one of the cross sectional width (BR) of the frame amounts to three fourths or less of the cutting cross sectional width (BF) of the at least two lower cutting/mixing wheels, and the cross sectional length (LR) of the frame amounts to three fourths or less of the cutting cross sectional length (LF) of the at least two lower cutting/mixing wheels.

4. Device according to claim 1, wherein at least one of the frame and the cutting/mixing wheels are designed mirror symmetrically, with respect to a mirror plane extending perpendicularly to at least one of the advance direction and to a mirror plane extending in the advance direction.

5. Device according to claim 1, wherein the two lower cutting/mixing wheels and the two upper cutting/mixing wheels are provided with parallel axes.

6. Device according to claim 1, wherein at the bottom of the frame, between two adjacent lower cutting/mixing wheels, a liquid supply device is provided for supplying a settable liquid into the trench.

7. Device according to claim 1, wherein at least on the lower cutting/mixing wheels, cutting teeth are provided for stripping outcropping soil material, and on the frame scraper plates are provided which project between adjacent cutting teeth in order to free the cutting teeth from stripped soil material.

8. Device according to claim 1, wherein on the frame hydraulically operable control props are provided, which are extendable transversely to the advance direction, in order to abut against the inner walls of the trench.

9. Device according to claim 8, wherein two pairs of control props are each arranged on top of each other on both sides of the frame.

10. Device according to claim 1, wherein at least one of a rope and a telescopic drill rod is provided on which the frame is suspended by its upper side.

11. Device according to claim 1, wherein the cutting cross section of the at least two upper cutting/mixing wheels and of the at least two lower cutting/mixing wheels is changeable.

12. Method for making a trench wall in the soil, comprising the steps of:

providing a device according to claim 1 for making a trench wall in the soil, setting the cutting/mixing wheels into rotation by means of a rotary drive, and sinking the device into the soil and retracting the device upon reaching a final depth, with both the two upper cutting/mixing wheels and the two lower cutting/mixing wheels being each driven in opposite directions by the rotary drive.

13. Method according to claim 12, wherein during the sinking of the device, soil material stripped at the bottom of the trench is removed from the cutter centre through the rotation of the lower cutting/mixing wheels.

14. Method according to claim 12, wherein the device includes cutting/mixing wheels lying on top of each other on the frame, and wherein the method comprises the further step of driving of driving the cutting/mixing wheels in one of an opposite direction and in the same direction.

15. Method according to claim 12, wherein in the step of sinking and retracting, the sense of rotation of at least the lower cutting/mixing wheels is reversed for the retraction of the device.

16. Device according to claim 3, wherein the cross sectional length (LR) of the frame amounts to half or less of the cutting cross sectional length (LF) of the at least two lower cutting/mixing wheels.

17. Device according to claim 8, wherein the hydraulically operable control props are extendable approximately parallel to the rotational axes of the cutting/mixing wheels.

* * * * *